US007354246B2

(12) United States Patent
Malone et al.

(10) Patent No.: US 7,354,246 B2
(45) Date of Patent: Apr. 8, 2008

(54) ELECTRONICS COOLING FAN WITH COLLAPSIBLE FAN BLADE

(75) Inventors: Christopher G. Malone, Loomis, CA (US); Glenn C. Simon, Auburn, CA (US); Ricardo Espinoza-Ibarra, Lincoln, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 27 days.

(21) Appl. No.: 11/260,095

(22) Filed: Oct. 26, 2005

(65) Prior Publication Data

US 2007/0092376 A1 Apr. 26, 2007

(51) Int. Cl.
*F01D 5/00* (2006.01)
*H05K 7/20* (2006.01)

(52) U.S. Cl. ..... 416/44; 416/51; 416/88; 416/132 A; 416/143; 416/240

(58) Field of Classification Search ..... 416/44, 416/51, 87, 88, 132 A, 142, 143
See application file for complete search history.

(56) References Cited

U.S. PATENT DOCUMENTS

| | | | | |
|---|---|---|---|---|
| 1,868,113 | A * | 7/1932 | Ljungstrom | 416/143 |
| 4,334,824 | A * | 6/1982 | Tsuchikawa et al. | 416/132 R |
| 5,851,106 | A | 12/1998 | Steiner et al. | |
| 5,993,158 | A * | 11/1999 | Young | 416/132 R |
| 6,027,309 | A | 2/2000 | Rawls et al. | |
| 6,031,717 | A | 2/2000 | Baddour et al. | |
| 6,109,874 | A | 8/2000 | Steiner et al. | |
| 6,860,713 | B2 | 3/2005 | Hoover | |
| 2004/0101406 | A1 | 5/2004 | Hoover | |
| 2004/0141288 | A1 | 7/2004 | Franz et al. | |
| 2005/0047087 | A1 | 3/2005 | Espinoza-Ibarra et al. | |

* cited by examiner

*Primary Examiner*—Edward K. Look
*Assistant Examiner*—Nathan Wiehe

(57) ABSTRACT

An electronics cooling fan comprises at least one collapsible fan blade driven by centrifugal force to extend radially as the fan spins and driven by elastic force to retract as spinning slows or stops.

17 Claims, 7 Drawing Sheets

ELECTRONICS COOLING FAN WITH COLLAPSIBLE FAN BLADE

BACKGROUND OF THE INVENTION

Electronic systems and equipment such as computer systems, network interfaces, storage systems, and telecommunications equipment are commonly enclosed within a chassis, cabinet or housing for support, physical security, and efficient usage of space. Electronic equipment contained within the enclosure generates a significant amount of heat. Thermal damage may occur to the electronic equipment unless the heat is removed.

Electronic systems commonly include heat-dissipating components such as processors, central processing units (CPUs), signal processors, and others. One or more fans are used to push air through the system and over components to avoid overheating of the heat-dissipating components. In recent years electronic systems have become more densely packaged so that system design within power and heat dissipation allowances has become more difficult. This system evolution creates design challenges in aspects of power consumption and the effect of fans on overall system heat dissipation characteristics.

An electronics system may have multiple fans including, for example, multiple fans arranged in series to supply sufficient cooling and redundancy in case of failure of one or more fans. If one or more of the series-connected fans fails due to any of various mechanical or electrical failures, power failure or shutdown due to attempts to operate above a system power budget, physical obstruction of a fan rotor, or the like, the failed fan may create a drag on cooling airflow through the system. Drag in the airflow pathway can result in increased demand on other fans, overheating of electronic components and devices, and degradation in electronics performance. Electronics cooling fans typically fail when motor bearing lubricant dries, which may result in a locked rotor. Fan failure may create heavy resistance to airflow through the electronics system due to blockage created by stationary fan blades.

SUMMARY

In accordance with an embodiment of an electronics cooling fan, the electronics cooling fan comprises at least one collapsible fan blade driven by centrifugal force to extend radially as the fan spins and driven by elastic force to retract as spinning slows or stops.

BRIEF DESCRIPTION OF THE DRAWINGS

Embodiments of the invention relating to both structure and method of operation may best be understood by referring to the following description and accompanying drawings whereby.

DETAILED DESCRIPTION

Figure 1:
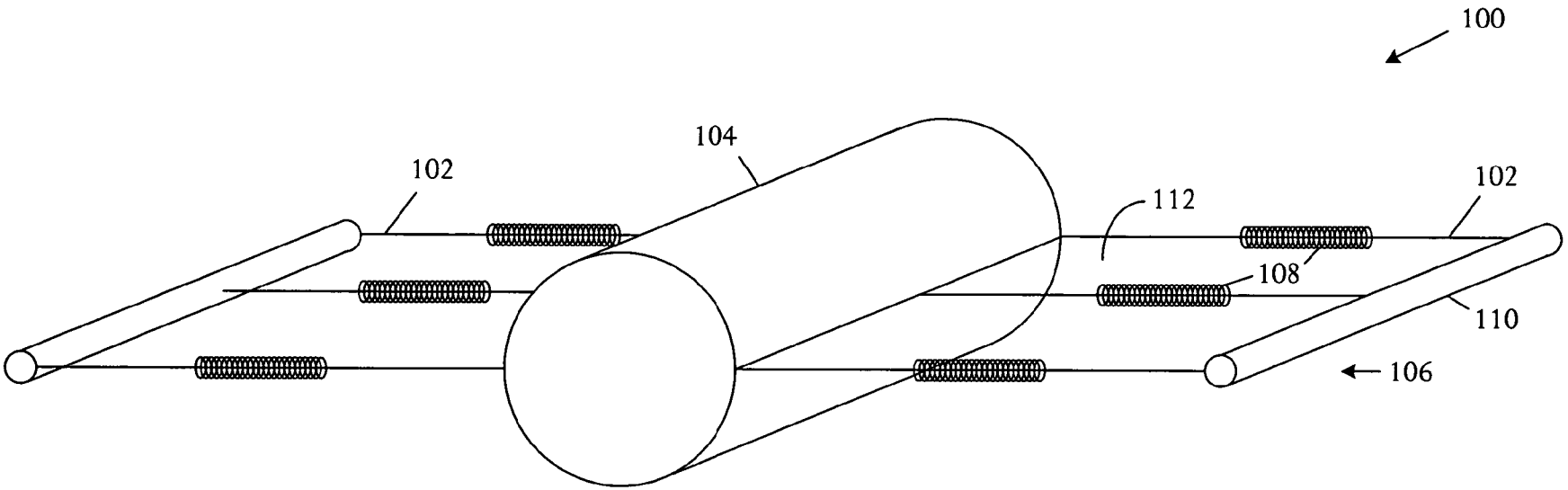
FIG. 1 is a schematic physical diagram depicting fundamental aspects of various fan rotor systems with collapsible fan blades driven by centrifugal forces.

Referring to FIG. 1, a schematic physical diagram depicts fundamental aspects of various fan rotor systems 100 with collapsible fan blades 102 driven by centrifugal forces. The diagram illustrates a structure and technique enabling reduction of backpressure created by blades of a failed fan. The technique exploits the centrifugal force generated when a fan motor rotates a fan rotor 104. The fan blades 102 are fabricated from a conformal material such as a flexible material, multiple linked collapsible shells, or other arrangements. A spring and mass system 106, comprising springs 108 and masses 110, is attached to a rotor 104 or motor hub and is typically formed underlying an airfoil surface 112. As the motor spins the rotor 104, centrifugal forces overcome the spring force and drive the mass 110 away from the hub 104. The centrifugal forces acting on the masses 110 can fully deploy the flexible airfoil surfaces 112 or collapsible shells, enabling the fan to deliver a pressure gradient and airflow. In the event of a motor or other fan failure, the centrifugal force is reduced or terminated and the springs 108 pull the mass 110 and conformal airfoil material inward toward the hub 104, creating an open annular area through which air may flow with a reduced pressure drop in comparison to the passage area that would be present with stationary blades remaining in place.

Figure 2:
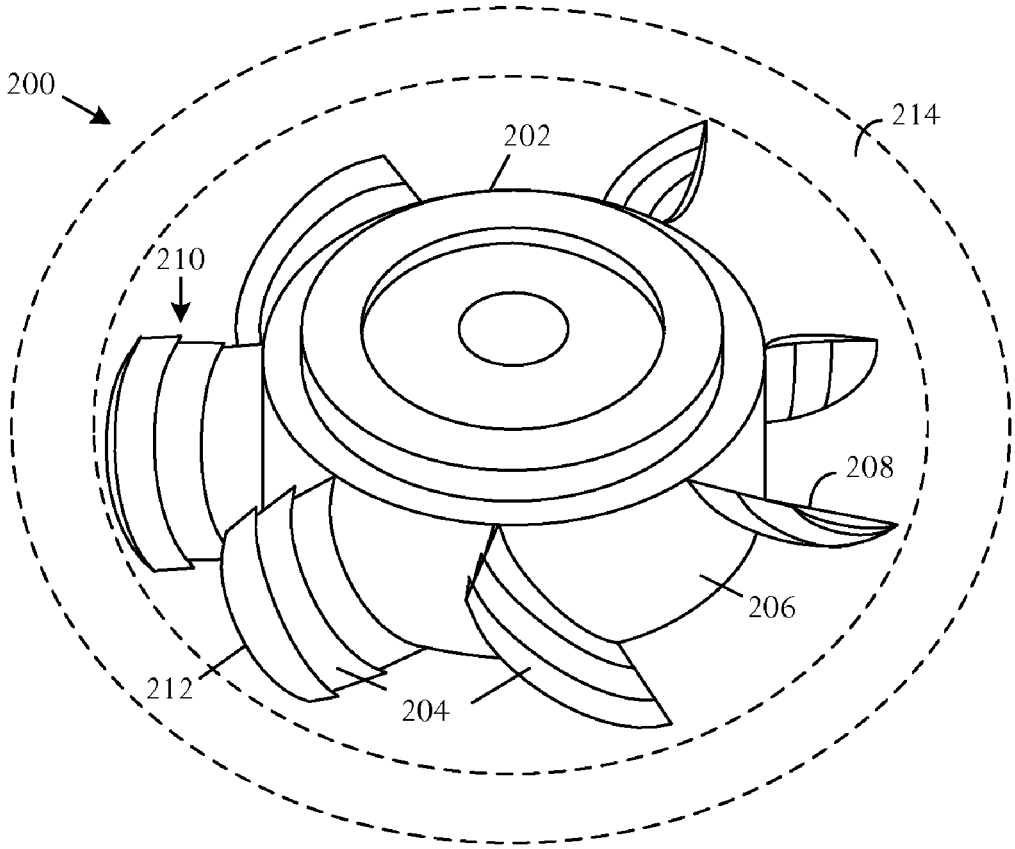
FIG. 2 is a perspective pictorial diagram illustrating an embodiment of an electronics cooling fan including a fan rotor system with collapsible blades driven by centrifugal forces.

Referring to FIG. 2, a perspective pictorial diagram illustrates an embodiment of an electronics cooling fan 200 including a fan rotor system 202 with collapsible blades 204 driven by centrifugal forces. A cooling apparatus comprises the electronics cooling fan 200 in a configuration adapted for rotational motion to generate an axial airflow pathway. The electronics cooling fan 200 comprises one or more collapsible fan blades 204 driven by centrifugal force to extend radially as the fan 200 spins and driven by elastic force to retract as spinning slows or stops.

Retraction of the collapsible fan blades 204 when the fan 200 stops spinning reduces or minimizes obstruction to airflow through the fan. In contrast, a traditional fan, upon failure, has fan blades that stop spinning and block airflow through the fan.

The electronics cooling fan 200 comprises a hub 206 adapted for rotational motion and multiple collapsible fan blades 204 coupled to the hub 206. In various implementations, embodiments and forms the collapsible fan blades 204 comprise an airfoil surface 208 and a spring-and-mass element 210. The airfoil surface 208 and the spring-and-mass element 210 may be distinct elements in some configurations and may be combined in inseparable elements in other configurations.

The spring-and-mass element 210 is designed with a selected mass configuration and a selected elasticity so that, as the hub 206 spins, the centrifugal force exceeds spring force and drives the mass away from the hub 206, thereby extending lateral edges 212 of the airfoil surface 208 outward from the hub 206. The rotation speed of fans in many high performance applications is sufficient to generate a centrifugal force that enables extension of the collapsible fan blades 204.

The selected mass configuration and selected elasticity of the spring-and-mass element 210 are further designed so that, as the hub spin speed is reduced or stopped, the spring force retracts the mass inward toward the hub 206 and collapses the collapsible fan blades 204 and forming an open annular area radially outward from the hub 206. The open annular area 214 enables airflow through the electronics cooling fan 200.

The fan blades may be implemented in any suitable shapes and/or sizes, and are commonly formed with known aerodynamic contours. For illustrative purposes, some of the fan blades depicted herein are shown in simple rectangular forms to describe aspects of spring-and-mass elements related to generation of centrifugal and spring forces with little complexity. Typically, collapsible fan blades are to be implemented with common aerodynamic shapes.

Figure 3A:
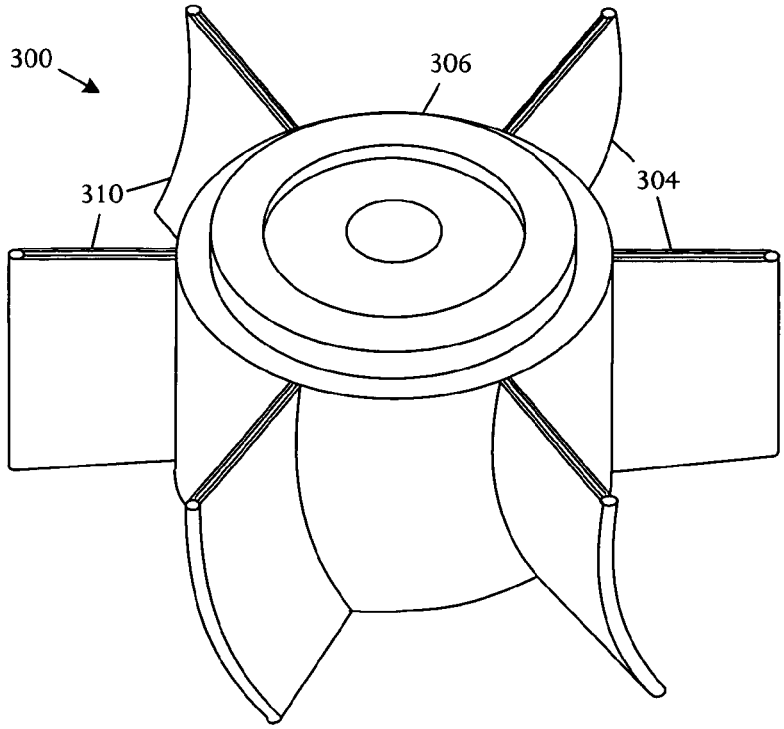
FIG. 3A is a perspective pictorial diagram showing an embodiment of a fan assembly comprising a hub and one or more collapsible fan blades constructed as flexible elastic members.
Figure 3B:
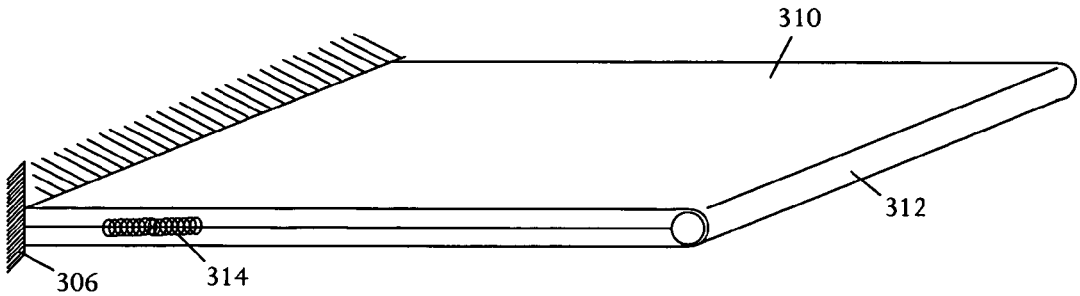
FIGS. 3B and 3C are perspective pictorial diagrams depicting two examples of collapsible fan blades that may be used in fan assembly embodiments.
Figure 3C:
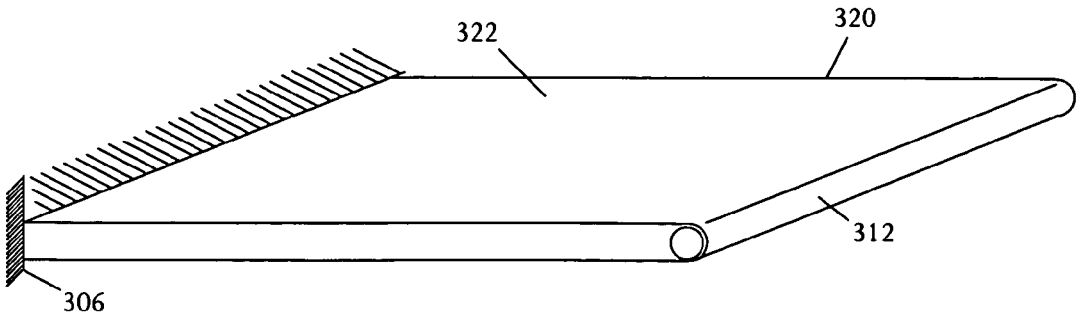

Referring to FIG. 3A, a perspective pictorial diagram illustrates an embodiment of a fan assembly 300 comprising a hub 306 and one or more collapsible fan blades 304 constructed as a flexible elastic member 310. FIGS. 3B and 3C depict two examples of collapsible fan blades that may be used in fan assembly embodiments. The flexible elastic member 310 is typically constructed of an elastic material such as rubber, synthetic elastomeric materials, flexible plastics, and the like to function as a spring-and-mass element. Based on specifications of the fan to which the fan assembly 300 is mounted, for example fan speed criteria, the flexible elastic member 310 is designed with a selected elasticity and three-dimensional elasticity distribution, and with a selected mass and three-dimensional mass distribution to cause the collapsible fan blades 304 to extend when the fan is rotating at a selected minimum fan speed and to collapse when the fan is stopped or rotating below the specified minimum speed. The minimum speed of operation may be defined as the angular velocity at which the fan blades are completely extended or unfurled. Typically, at rotation speeds greater than the minimum speed, no further extension occurs.

Referring to FIG. 3B, in an illustrative embodiment the flexible elastic member 310 has a mass element 312, for example a weighted rod or bar, attached to an edge of the elastic member 310 most distal from the hub 306. When the fan 300 begins to spin, the mass is driven away from the hub center by centrifugal force. The fan blade is constructed from a flexible, elastic material so that the centrifugal force drags the elastic member 310 outward. Fan rotation creates an airflow which, in turn, generates a pressure drop, a pressure differential between the inlet and outlet of the fan 300. In absence of rotation, the centrifugal force recedes and the mass pulls back toward the central hub 306 by operation of a spring 314, such as a light spring. Accordingly, the elastic member 310 flexibly and automatically modifies the airfoil surface to generate airflow during fan operation and leave an aperture open without blockage when the fan is stopped. In some embodiments, the flexible elastic member 310 may be selected from a material that thins in cross-section during extension and thickens during collapse.

FIG. 3C illustrates an embodiment of a flexible elastic member 320 comprising a mass element 312 attached to the hub 306 by a flexible elastic sheath 322 which is sufficiently resilient that a separate spring may be omitted.

In various other configurations, the flexible elastic member 310 may be arranged with other mass distributions, such as a uniform mass throughout without an increased mass at the distal end of the member 310. Any suitable mass distribution may be implemented to produce a selected behavior during application of centrifugal force.

The flexible elastic member 310 is typically configured in aerodynamic fan blade geometry.

In some embodiments, the flexible elastic member 310 is designed with a mass configuration and elastic spring force adapted to respond to fan rotation by producing a centrifugal force that exceeds the spring force during fan rotation with the elastic spring force selected to limit excursion of the collapsible fan blade 304 to a selected radial distance. Radial excursion is limited to prevent the extended blades 304 from striking a fan housing for fan assemblies contained within a housing.

Other embodiments may include a mechanical restraint or stopper element, for example a tab at the end of a rod, which limits blade excursion.

Figure 4A:
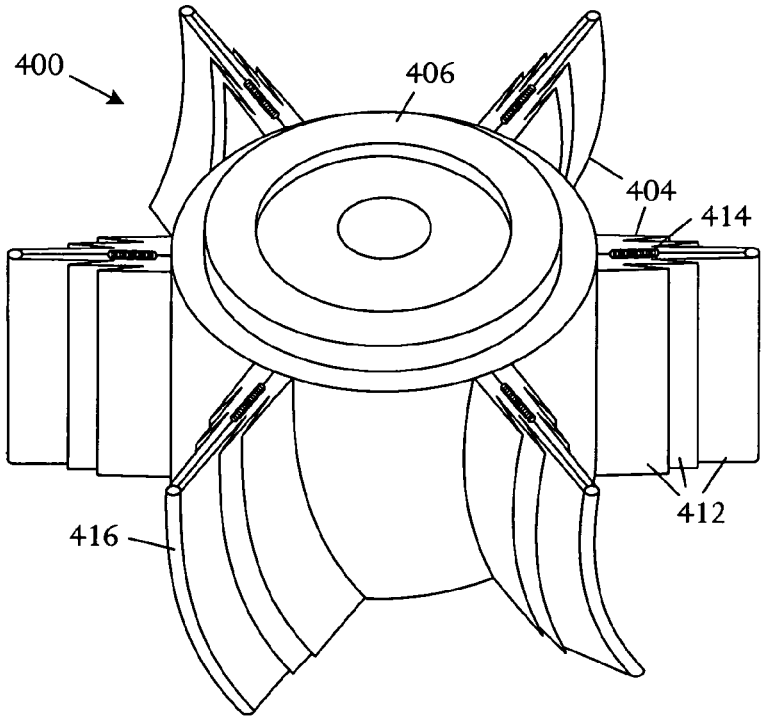
FIGS. 4A and 4B respectively illustrate perspective pictorial diagrams showing an embodiment of a fan assembly and collapsible fan blade constructed as a plurality of telescoping sheeting layers and at least one spring.

Referring to FIG. 4A, a perspective pictorial diagram illustrates an embodiment of a fan assembly 400 comprising a hub 406 and one or more collapsible fan blades 404 each constructed as a plurality of telescoping sheeting layers 412 and at least one spring 414. The telescoping sheeting layers 412 function as a mass element which is distinct from the spring 414 so that spring and mass functionality are distinct in the illustrative embodiment shown in FIG. 4A.

The telescoping sheeting layers 412 form the fan blade 404 in multiple sections constructed from a suitable material such as plastic or metal that unfold or unfurl outward under centrifugal force and that collapse or retract when the fan stops spinning. Collapse of the metal or plastic sheets reduces or minimizes the cross-sectional area of the blade 404. In some implementations, the metal or plastic sheets may comprise a suitable mass upon which the centrifugal force acts and the fan may spin sufficiently fast so that the blade extends without addition further material or mass. In other implementations, additional weight or mass may be added to the structure to ensure extension. In contrast to the embodiment employing an elastic material for usage as a fan blade 304 depicted in FIGS. 3A, 3B, and/or 3C, the telescoping sheeting layers 412 generally do not inherently have sufficient resilience for automatic retraction. Accordingly, the spring 414 is attached to retract the blade 404 when the centrifugal force decreases due to reduction or termination of angular motion.

The telescoping sheeting layers 412 may be configured as very thin and rigid flat plates, each having a form selected to create an aerodynamic fan blade shape as centrifugal force expands the blade 404.

The mass distribution of the sheeting layers 412 and the elastic characteristics of the spring or springs 414 are selected in combination with selected fan speed specifications to produce appropriate response to centrifugal forces. Mass and elastic properties are balanced to extend the collapsible fan blades 404 during fan rotation at a selected minimum speed and otherwise collapsing the blades. In some arrangements, the multiple sheeting layers may have the same mass distribution. In other embodiments, sheets may have differing mass distributions. Similarly, sheets with a mass distribution varies in planar space may be used. Some implementations may use mass elements, for example weight blocks, attached selectively to the sheeting layers. The illustrative embodiment has a mass element 416 attached to the distal edge of the sheeting layer most distal from the hub 406.

Figure 4B:
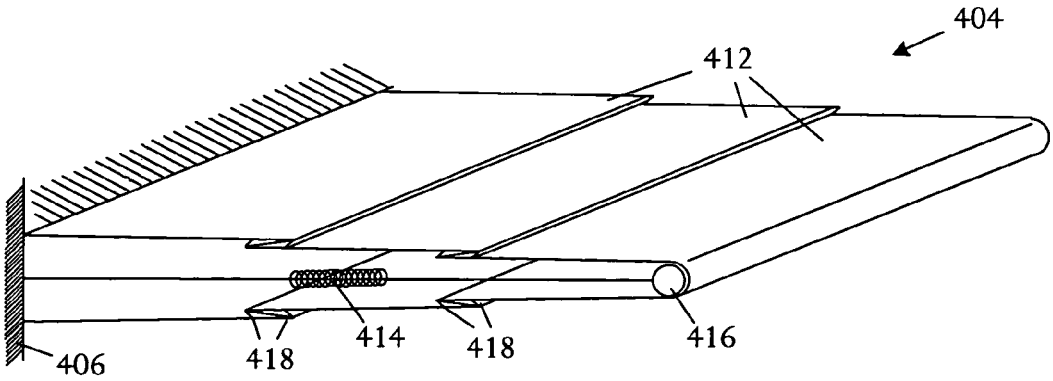

The telescoping sheeting layers 412 are configured with a mass configuration and the one or more springs 414 selected to have a spring force appropriate to create a centrifugal force that exceeds the spring force during fan rotation. The telescoping sheeting layers 412 have flanges 418, shown in FIG. 4B, that limit excursion of the collapsible fan blades 404 to a selected radial distance.

Figure 5A:
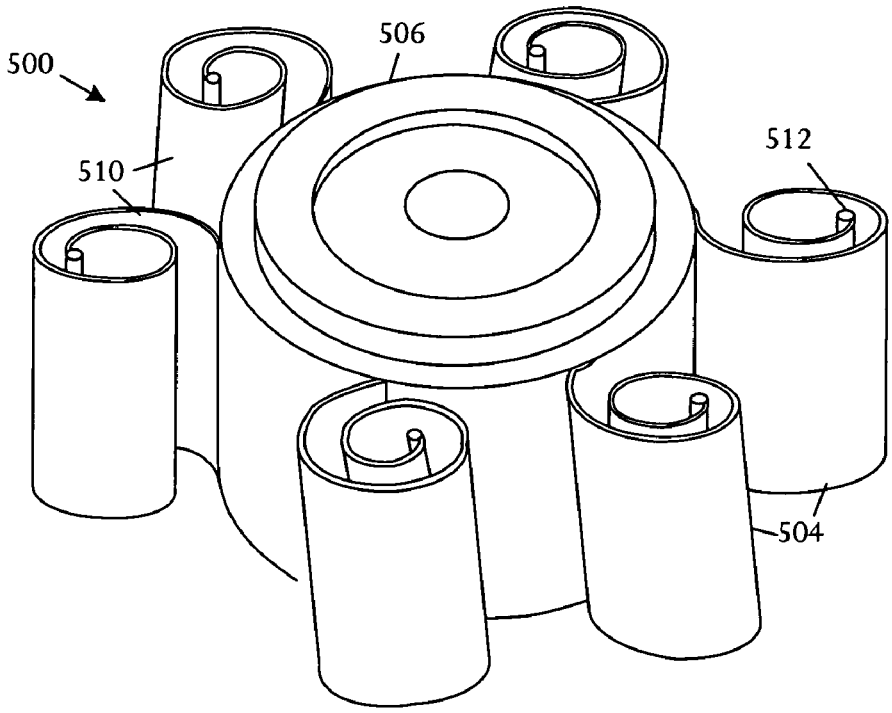
FIGS. 5A and 5B show perspective pictorial diagrams illustrating an embodiment of a fan assembly and a collapsible fan blade for the assembly configured as spiral coil spring sheath.

Referring to FIG. 5A, a perspective pictorial diagram illustrates an embodiment of a fan assembly 500 comprising a hub 506 and one or more collapsible fan blades 504 configured as spiral coil spring sheaths 510. The spiral coil spring sheath 510 has a mass configuration and spring force balanced so that the centrifugal force exceeds the spring force during fan rotation above a predetermined minimum extension speed, extending the fan blade 504. The spring force is selected to exceed the centrifugal force during fan rotation below the minimum extension speed so that the fan blade 504 is collapsed.

Figure 5B:
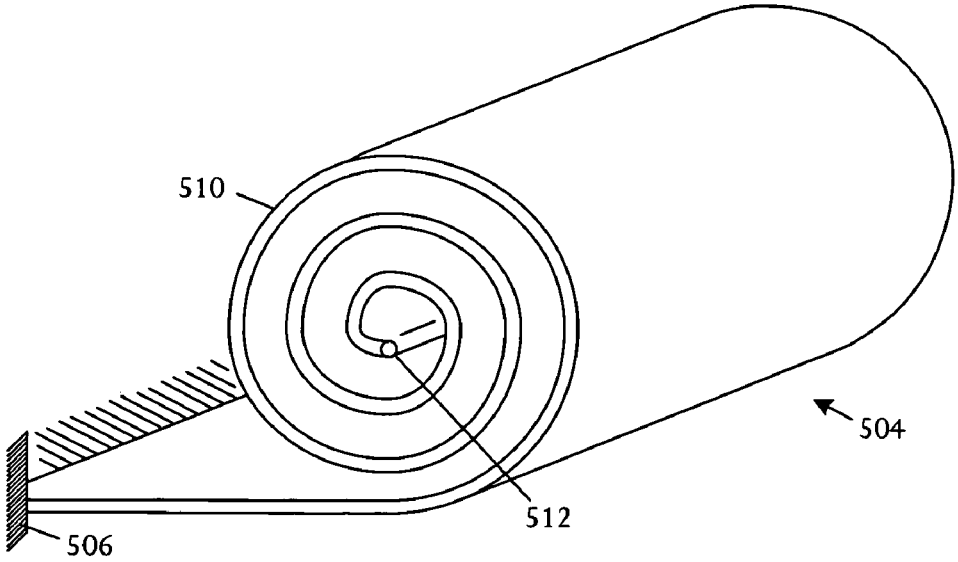

FIG. 5B is a perspective pictorial diagram illustrating the collapsible fan blades 504 with additional detail. The spiral coil spring sheath 510 functions on the basis that the blade 504 is a spiral coil spring that rolls out during rotation and recoils in the absence of rotation. Centrifugal force may act, for example, upon a weighted rod 512 attached at a suitable position on the coil. In various embodiments, the spiral coil may have resilience that ranges from relatively light to a relatively heavy spring, based on the mass and mass distribution of the sheath and the motor speed. The mass may be distributed in a suitable location along the spiral coil spring sheath 510, for example one or more weighted rods 512 for a localized mass or a mass distribution integrated into sheathing material such as a fabric attached to a spring.

In some configurations, the spring force may limit excursion to a selected radial distance. In other arrangements, a mechanical stop element may be added to limit excursion to a selected radial distance.

Figure 6A:
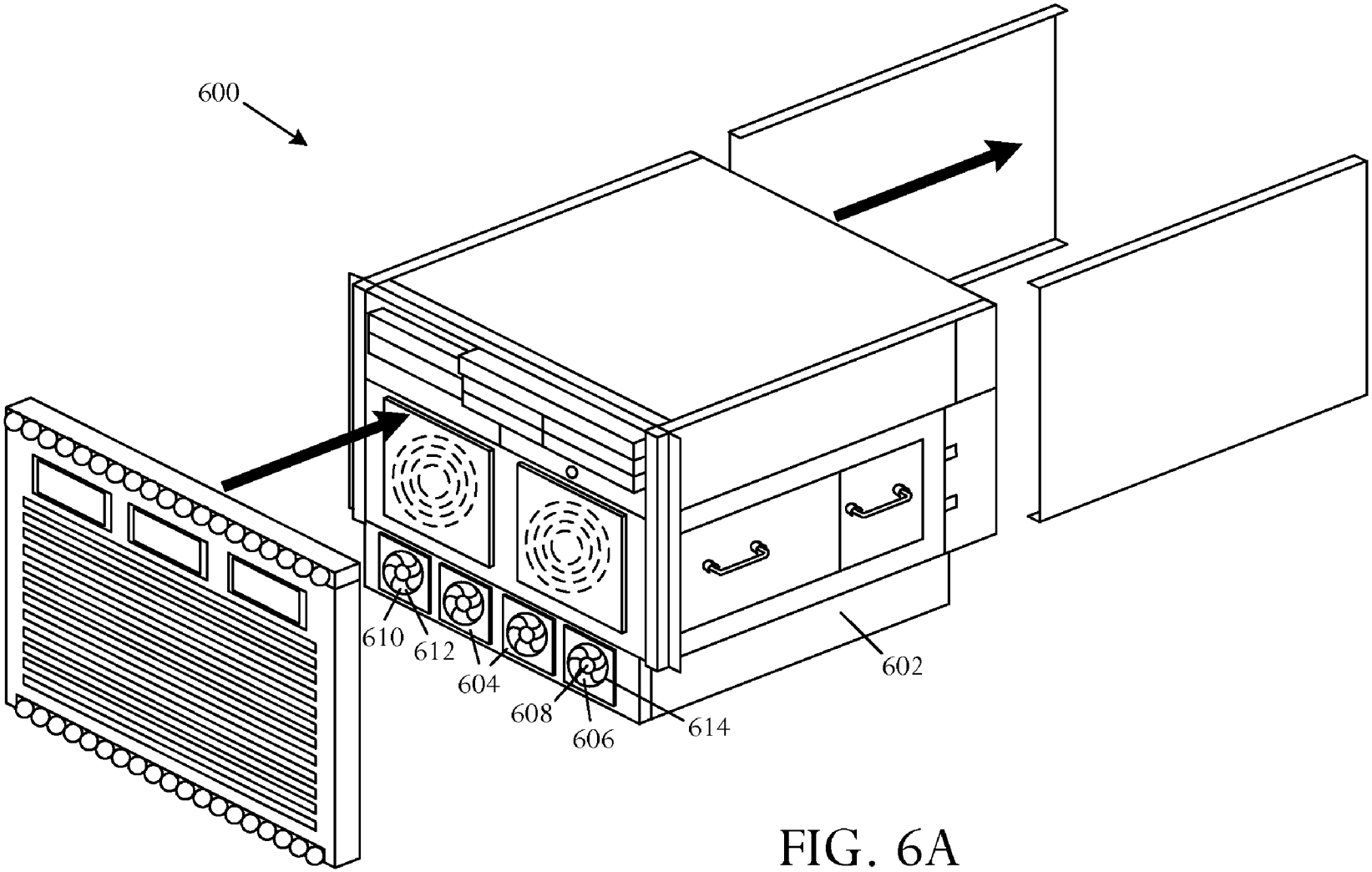
FIGS. 6A and 6B are perspective pictorial diagrams respectively illustrating an embodiment of an electronics cooling apparatus and electronics cooling fans for usage in the electronics cooling apparatus.

Referring to FIG. 6A, a perspective pictorial diagram illustrates an embodiment of an electronics cooling apparatus 600 comprising a chassis 602 and multiple electronics cooling fans 604 contained within the chassis 602. The electronics cooling fans 604 are adapted for rotational motion that generates an axial airflow pathway. The electronics cooling fans 604 comprise one or more collapsible fan blades 606 which are driven by centrifugal force to extend radially as the fan spins, and driven by elastic force to retract as spinning slows or stops.

Figure 6B:
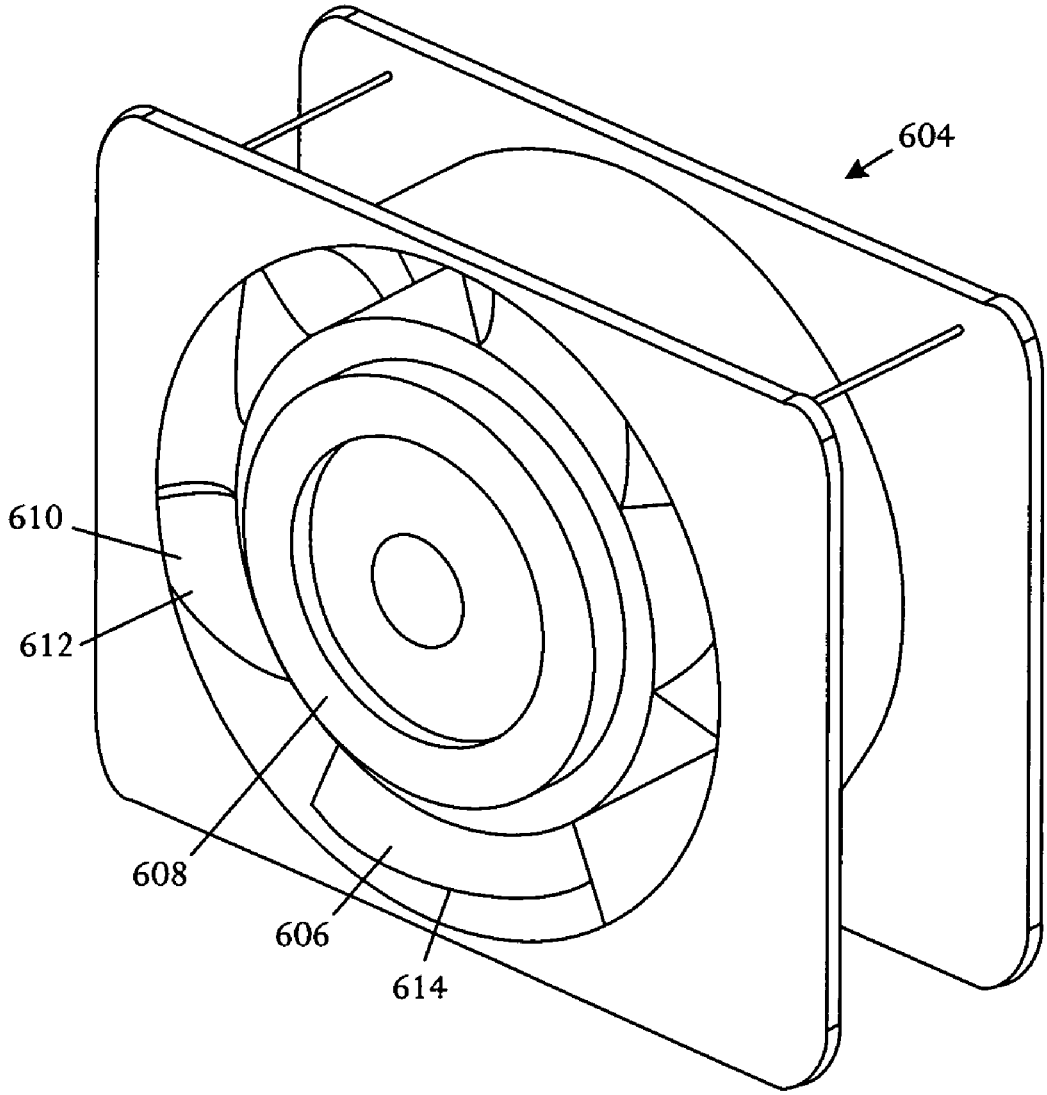

Referring to FIG. 6B, a perspective pictorial diagram illustrates an embodiment of an electronic cooling fan 604 that is suitable for usage in the electronics cooling apparatus 600. The electronics cooling fans 604 comprise a hub 608 adapted for rotational motion and one or more collapsible fan blades 606 coupled to the hub 608 and comprising an airfoil surface 610 and a spring-and-mass element 612.

The electronics cooling apparatus is designed by configuring and forming the electronics cooling fans 604 in an arrangement selected to create rotational motion and generate an axial airflow pathway. Typically the number and type of fans is selected to produce appropriate cooling for a particular functional configuration. High performance electronics systems typically include one or more integrated circuit components that produce a large amount of heat. The number of electronics cooling fans 604 and motors driving the fans 604 is selected to produce suitable cooling airflow.

Fan selection is based on functional specifications of the system. Fans typically run at faster speeds and with higher phase motors due to meet cooling specifications for systems with increased functionality. Higher performance fans that run at faster speeds generate more power and thus a higher centrifugal force, enabling operation of the disclosed collapsible fan blades. The illustrative fans with collapsible fan blades 606 exploit the centrifugal force naturally produced by the fans to enable the fan blades to automatically expand during operation and automatically collapse and thereby retract when the fan is not longer rotating. The collapsible character of the fan blades is typically attained by usage of airfoils constructed from a flexible material or fabric, or by usage of articulating joints in rigid fan blade structures.

Based on the selection of fan motor, the collapsible fan blades 606 may be designed so that the blades 606 are driven by centrifugal force to extend radially as the fan spins and driven by elastic force to retract as spinning slows or stops. Accordingly, the spring-and-mass elements 612 forming the fan blades 606 are configured so that as the hub 608 spins at a selected minimum fan speed, the centrifugal force exceeds spring force and drives the mass away from the hub 608, extending airfoil surface lateral edges 614 outward from the hub 608. The spring-and-mass elements 612 can be further designed so that as the hub spin is reduced or terminated, the spring force retracts the mass inward toward the hub 608, forming an open annular area radially outward from the hub that enables airflow through the annular area.

For fans 604 that are contained within a housing, the collapsible fan blades 606 are generally designed to limit extension or excursion so that the spinning fans do not contact the housing. Various types of retaining or stopping devices may be used to limit flexible fan blade excursion. For example, for a flexible fan blade constructed of an elastic material such as a rubber or synthetic elastomer, the material may be selected according to elastic properties so that the material extends a selected known distance under the maximum operating speed of the fan motor. In other embodiments, a mechanical stop such as a flange or tab may be implemented that limits extension beyond a predetermined length. Collapsible fan blade implementations that include a spring which is distinct from fan blade sheeting or panels may have a stop mechanism configured to limit extension of the spring, thereby limiting length of the blade. Collapsible fan blade embodiments in the form of a frame or rigid sheeting layers may be constructed with built-in stops.

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclosed herein, and will understand that the process parameters, materials, and dimensions are given by way of example only. The parameters, materials, and dimensions can be varied to achieve the desired structure as well as modifications, which are within the scope of the claims. For example, although particular types of collapsible fan structures and techniques are illustrated and described, any suitable collapsible fan including an element adapted for elastic collapse may be used. Similarly, various fan arrangements are shown to facilitate expression of the structures and techniques. Any suitable number and arrangement of fans may be used and remain within the scope of the description. Also the illustrative structures and techniques may be used in any suitable electronics application including, for example, computers, blade systems, desktop personal computers or workstations, rack-mounted servers or other rack-mounted devices, storage systems, communication systems, and the like.

In the claims, unless otherwise indicated the article "a" is to refer to "one or more than one".

What is claimed is:

1. An apparatus comprising:

an electronics cooling fan comprising at least one flexible elastic collapsible fan blade driven by centrifugal force to extend outward radially as the fan spins and driven by elastic force to retract inward as spinning slows or stops;

the at least one flexible elastic collapsible fan blade comprising a weighted rod coupled to an elastic sheath formed in an aerodynamic shape.

2. The apparatus according to claim 1 further comprising:

a hub adapted for rotational motion; and the at least one flexible elastic collapsible fan blade coupled to the hub and further comprising a flexible elastic airfoil surface and a spring-and-mass element.

3. The apparatus according to claim 2 further comprising:

the spring-and-mass element configured whereby as the hub spins centrifugal force exceeds spring force and drives the mass away from the hub, extending flexible elastic airfoil surface lateral edges outward from the hub.

4. The apparatus according to claim 2 further comprising:

the spring-and-mass element configured whereby as the hub spin is reduced or terminated spring force retracts the mass inward toward the hub, forming an open annular area radially outward from the hub and enabling airflow through the annular area.

5. The apparatus according to claim 1 further comprising:

the at least one collapsible fan blade further comprising a flexible elastic member that expands outward radially as the fan spin speed increases and retracts inward as the fan spin speed decreases.

6. The apparatus according to claim 5 wherein:

the flexible elastic member has a mass configuration and elastic spring force adapted to create a centrifugal force that exceeds the spring force during fan rotation, the elastic spring force being adapted to limit excursion to a selected radial distance.

7. The apparatus according to claim 1 further comprising:

the at least one flexible elastic collapsible fan blade constructed from an elastic material selected from a group consisting of rubber, synthetic elastomeric material, and flexible plastic.

8. An electronics cooling apparatus comprising:

a chassis;

a plurality of electronics cooling fans contained within the chassis, ones of the electronics cooling fans comprising at least one flexible elastic collapsible fan blade driven by centrifugal force to extend outward radially as the fan spins and driven by elastic force to retract inward as spinning slows or stops;

the at least one flexible elastic collapsible fan blade comprising a weighted rod coupled to an elastic sheath formed in an aerodynamic shape.

9. The apparatus according to claim 8 wherein ones of the electronics cooling fan plurality further comprise:

a hub adapted for rotational motion; and the at least one flexible elastic collapsible fan blade coupled to the hub and further comprising a flexible elastic airfoil surface and a spring-and-mass element.

10. The apparatus according to claim 9 wherein ones of the electronics cooling fan plurality further comprise:

the spring-and-mass element configured whereby as the hub spins centrifugal force exceeds spring force and drives the mass away from the hub, extending flexible elastic airfoil surface lateral edges outward from the hub.

11. The apparatus according to claim 9 wherein ones of the electronics cooling fan plurality further comprise:

the spring-and-mass element configured whereby as the hub spin is reduced or terminated spring force retracts the mass inward toward the hub, forming an open annular area radially outward from the hub and enabling airflow through the annular area.

12. The apparatus according to claim 8 wherein ones of the electronics cooling fan plurality further comprise:

the at least one collapsible fan blade further comprising a flexible elastic member having a mass configuration and elastic spring force adapted to create a centrifugal force that exceeds the spring force during fan rotation, the elastic spring force being adapted to limit excursion to a selected radial distance.

13. The apparatus according to claim 8 wherein ones of the electronics cooling fan plurality further comprise:

the at least one flexible elastic collapsible fan blade constructed from en elastic material selected from a group consisting of rubber, synthetic elastomeric material, and flexible plastic.

14. An apparatus comprising:

an electronics cooling fan comprising at least one flexible elastic collapsible fan blade driven by centrifugal force to extend outward radially as the fan spins and driven by elastic force to retract inward as spinning slows or stops;

a hub adapted for rotational motion; and the at least one flexible elastic collapsible fan blade comprising a weighted rod coupled to the hub via an elastic sheath, and at least one spring coupled between the hub and the weighted rod.

15. An apparatus comprising:

an electronics cooling fan comprising at least one flexible elastic collapsible fan blade driven by centrifugal force to extend outward radially as the fan spins and driven by elastic force to retract inward as spinning slows or stops;

the at least one flexible elastic collapsible fan blade comprising a weighted rod coupled to an elastic sheath, the elastic sheath configured to thin in cross-section during extension and thicken during retraction.

16. An electronics cooling apparatus comprising:

a chassis;

a plurality of electronics cooling fans contained within the chassis, ones of the electronics cooling fans comprising at least one flexible elastic collapsible fan blade driven by centrifugal force to extend outward radially as the fan spins and driven by elastic force to retract inward as spinning slows or stops, wherein ones of the electronics cooling fan plurality further comprise:

a hub adapted for rotational motion; and the at least one flexible elastic collapsible fan blade comprises a weighted rod coupled to the hub via an elastic sheath, and at least one spring coupled between the hub and the weighted rod.

17. An electronics cooling apparatus comprising:

a chassis;

a plurality of electronics cooling fans contained within the chassis, ones of the electronics cooling fans comprising at least one flexible elastic collapsible fan blade driven by centrifugal force to extend outward radially as the fan spins and driven by elastic force to retract inward as spinning slows or stops, wherein ones of the electronics cooling fan plurality further comprise:

the at least one flexible elastic collapsible fan blade comprises a weighted rod coupled to an elastic sheath, the elastic sheath configured to thin in cross-section during extension and thicken during retraction.

* * * * *

UNITED STATES PATENT AND TRADEMARK OFFICE

CERTIFICATE OF CORRECTION

PATENT NO. : 7,354,246 B2
APPLICATION NO. : 11/260095
DATED : April 8, 2008
INVENTOR(S) : Christopher G. Malone et al.

It is certified that error appears in the above-identified patent and that said Letters Patent is hereby corrected as shown below:

In column 8, line 16, in Claim 13, delete “en” and insert -- an --, therefor.

Signed and Sealed this

Twenty-ninth Day of July, 2008

JON W. DUDAS
*Director of the United States Patent and Trademark Office*